US007164869B2

(12) United States Patent
Schoedinger

(10) Patent No.: US 7,164,869 B2
(45) Date of Patent: Jan. 16, 2007

(54) PRINT DELAY BASED ON MEDIA TYPE

(75) Inventor: Kevin D. Schoedinger, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 58 days.

(21) Appl. No.: 10/131,020

(22) Filed: Apr. 24, 2002

(65) Prior Publication Data

US 2003/0202813 A1 Oct. 30, 2003

(51) Int. Cl.
*G03G 15/20* (2006.01)

(52) U.S. Cl. ..... 399/69

(58) Field of Classification Search ..... 399/69, 399/70, 76, 38
See application file for complete search history.

(56) References Cited

U.S. PATENT DOCUMENTS 4,468,113 A 8/1984 Motohashi et al.
4,719,489 A 1/1988 Ohkubo et al.
4,737,817 A * 4/1988 Kando et al.
4,890,212 A * 12/1989 Kumon et al. ..... 399/335
5,140,375 A 8/1992 Shindo et al.
5,486,903 A 1/1996 Kanno et al.
5,512,992 A 4/1996 Kim et al.
5,585,908 A 12/1996 Rakov et al.
5,745,255 A 4/1998 Yamaguchi
5,822,651 A 10/1998 Yim et al.
5,848,321 A 12/1998 Roh et al.
5,893,661 A 4/1999 Sakai et al.
6,088,547 A 7/2000 Martin et al.
6,094,546 A * 7/2000 Nakazato et al. ..... 399/38
6,163,662 A 12/2000 Martin et al.

FOREIGN PATENT DOCUMENTS

JP 05254175 A * 10/1993
JP 2002055554 A * 2/2002

* cited by examiner

*Primary Examiner*—David M. Gray
*Assistant Examiner*—Ryan Gleitz
(74) *Attorney, Agent, or Firm*—Grossman, Tucker & Perreault

(57) ABSTRACT

A laser printer (10) having a fuser (220) to fix toner on sheets (214) in which the fuser element (225) heated by the power supply (121) of the printer is not capable of drawing enough power from the power supply to cause flicker. Thick or heavy media require more heat energy than paper. At cold-fuser start, the use of thick or heavy media is identified to the control system (14) and the control system adds a predetermined period to the normal delay to start printing. This invention may be implemented by a small addition to control software.

4 Claims, 4 Drawing Sheets

PRINT DELAY BASED ON MEDIA TYPE

TECHNICAL FIELD

This invention relates to printers and other imaging devices that must be warmed prior to initiating imaging. More specifically, this invention relates to providing for adequate warming for heavy or thick media while not burdening the time to print for common media such as paper. This permits the heater size to be reduced to avoid flicker.

BACKGROUND OF THE INVENTION

Applying high power to an internal heater or heaters of the printer can warm fusers and other elements of printer fairly rapidly. However, such application of power in an ordinary business or office setting may divert power from related systems and cause flicker of lights powered by such systems. Flicker is undesirable as it is distracting and the drain of power evidenced by flicker may interfere with the operation of other apparatus. At least one state in Europe has requirements directed to flicker.

Flicker can be avoided with special apparatus or systems such as coils installed as chokes and surge control circuits. These add expense to the printer and limit initial power to the heater. This invention requires only a control system, which may be only software used with pre-existing elements. This invention delays printing for heavy or thick media, while the use of chokes or surge control delays power to the heater. Delay of power to the heater inherently delays printing since printing is not initiated until the appropriate temperature is reached.

The adding of delays for a printer to reach certain temperatures before launching a sheet to be printed is prior and established in the printer art. This is done in known embodiments by storing a table of the time period to delay or a table of the offset from an operating temperature value normally sensed for. These delays are specific to heavy or thick media in contrast to normal media. The prior art, however, is not known to add to such delays at cold start nor to combine the added delay with a lower power supply to avoid flicker.

DISCLOSURE OF THE INVENTION

In accordance with this invention, a heater in the printer or other imaging device is employed which is of medium power output such that it is not capable of causing flicker when connected to a normal office power source. At turn-on of the printer from a start at which the fuser is not being heated (termed here a cold-fuser start), the control system imposes a delay before initiating printing. The primary purpose for heating of the printer often is to prepare the fuser of a laser printer for operation. As is conventional, a sensor monitors the temperature of the fuser. The delay imposed may be a direct result of monitoring the temperature sensed and launching the media sheet when the fuser reaches a predetermined temperature which assures adequate heat when the sheet reaches the fuser. Alternatively, the delay may be for a predetermined period of time after fuser heating is initiated.

Where heavy or thick media is identified to the control system, in accordance with this invention, at turn-on from a cold-fuser start, the control system imposes a longer delay. Where the temperature sensor is employed to define the delay, the control system launches a sheet at a higher sensed temperature. A typical delay for normal media when this invention is implemented is 30 seconds. Actual line voltages and other factors influencing temperature can vary this. For heavy or thick media, this invention adds 10 to 15 seconds, making the overall delay about 40 to 45 seconds. Delays for heavy or thick media when the device is in operation are much shorter.

By adding this delay, the required heater wattage is reduced to support cold-fuser starts without significant added delay for paper and the like and to support continuous operation once the fuser is warmed for all media. The lower wattage design can avoid flicker.

Identification of the media to be printed as heavy or thick may be defined by code in a communicated print job, but often it will necessarily be defined by the printer operator making an entry in the control panel. Typically, a control panel has several keys that can be used in sequences or combinations or both to define unique entries. Often, use of pre-existing keys can be defined to specify heavy or thick media, since not all entry alternatives have been used.

DESCRIPTION OF THE DRAWINGS

The details of this invention will be described in connection with the accompanying drawings, in which.

DESCRIPTION OF THE EMBODIMENTS

Printing System

Figure 1:
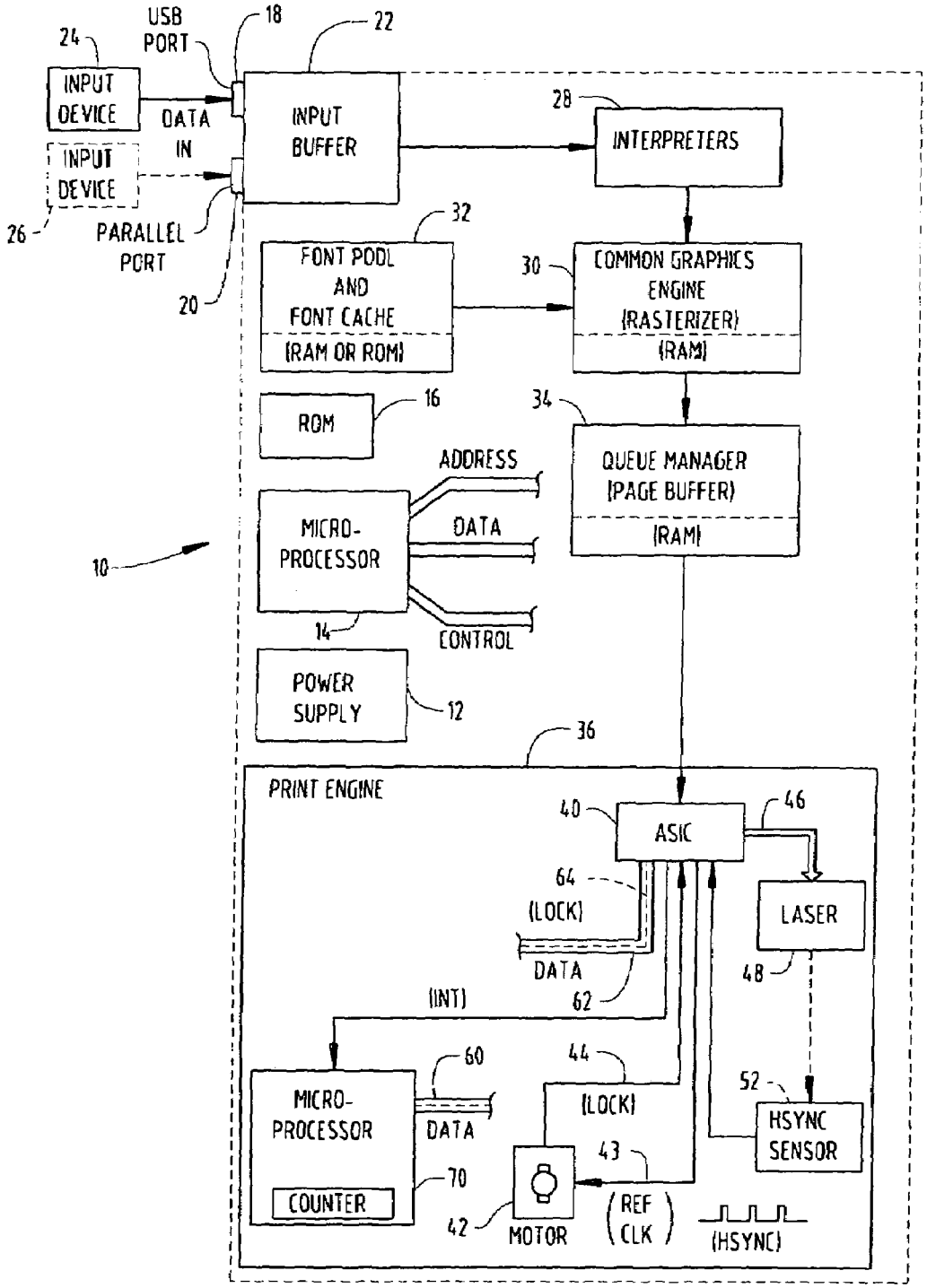
FIG. 1 is a hardware block diagram of the major components used in a laser printer which may incorporate this invention.

Referring now to the drawings, FIG. 1 shows hardware block diagram of a laser printer generally designated by the reference numeral 10. Laser printer 10 will preferably contain certain relatively standard components, such as DC power supply 12 which may have multiple outputs of different voltage levels, a microprocessor 14 having address lines, data lines and control and/or interrupt lines, Read Only Memory (ROM) 16, and Random Access Memory (RAM), which is divided into several portions for performing several different functions.

Power supply 12 receives electrical current by electrical cord plugged into an outlet, such as a standard wall outlet. It is the electrical system supporting the outlet, which is significantly reduced in power when flicker or the like results. The typical source of power to such outlets is limited in capacity, which allows flicker to occur.

Laser printer 10 will typically contain at least one serial input, parallel input or USB port, or in many cases two types of input ports, as designated by the reference numeral 18 for the serial port and the reference numeral 20 for the parallel port. Each of these ports 18 and 20 would be connected to a corresponding input buffer, generally designated by the reference numeral 22 on FIG. 1. USB port 18 would typically be connected to a USB output port of a personal computer or a workstation that would contain a software program such as a word processor or a graphics package or computer aided drawing package. Similarly, parallel port 20 could also be connected to a parallel output port of the same type of personal computer or workstation containing the same type of programs, only the data cable would have several parallel lines. Such input devices are designated, respectively, by the reference numerals 24 and 26 on FIG. 1.

Once the text or graphical data has been received by input buffer 22, it is commonly communicated to one or more interpreters designated by the reference numeral 28. A common interpreter is PostScript™, which is an industry standard used by most laser printers. After being interpreted, the input data is typically sent to a common graphic engine to be rasterized, which typically occurs in a portion of RAM designated by the reference numeral 30 on FIG. 1. Such font pools and caches supply bitmap patterns for common alphanumeric characters so that the common graphics engine 30 can easily translate each such character into a bitmap using a minimal elapsed time.

Once the data has been rasterized, it is directed into a queue manager or page buffer, which is a portion of RAM, designated by reference numeral 34. In a typical laser printer, an entire page of rasterized data is stored in the queue manager during the time interval that it takes to physically print the hard copy for that page. The data within the queue manager 34 is communicated in real time to a print engine designated by the reference numeral 36. Print engine 36 includes the laser light source within the printhead, and its output results in physical inking on a piece of paper or other media, which is the final print output from laser printer 10.

It will be understood that the address, data and control lines are typically grouped in buses, and which are physically communicated in parallel (sometime also multiplexed) electrically conductive pathways around the various electronic components within laser printer 10. For example, the address and data buses are typically sent to ROM and RAM integrated circuits, and the control lines or interrupt lines are typically directed to all input or output integrated circuits that act as buffers.

Print engine 36 contains an ASIC (Application Specific Integrated Circuit) 40, which acts as a controller and data manipulating device for the various hardware components within the print engine. The bitmap print data arriving from queue manager 34 is received by ASIC 40, and at the proper moment is sent via signal lines 46 to the laser, which is designated by the reference numeral 48.

ASIC 40 controls the various motor drives within the print engine 36, and also receives status signals from the various hardware components of the print engine. A motor 42 is used to drive the faceted mirror (see the polygonal mirror 116 on FIG. 2), and when motor 42 ramps up to a rotational speed (i.e., its "lock" speed) that is dictated or measured by the frequency of the reference signal ("REF CLK") at a signal line 43, a "Lock" signal will be enabled on a signal line 44 that is transmitted to ASIC 40.

The lock signal may be dictated or controlled by various alternatives. Where the lock speed is to be different for different applications by the same printer 10, reference frequencies are supplied to track motor 42 that supports different lock speeds at different reference frequencies. Where only a single lock speed is to be employed by motor 42, the HSYNC signal (discussed below) may be supplied to motor 42 with a predetermined comparison to motor speed defining lock.

During conventional operation, once ASIC 40 receives the lock signal from motor 42, it transmits a corresponding lock signal (as part of a byte of a digital signal) along one of the data lines 64 of the data bus 62 that communicates with ASIC 40. Data bus 62 is either the same as the data bus 60 that communicates with microprocessor 70, or a portion thereof. When this lock status signal is received by microprocessor 70, microprocessor 70 initiates action of printer 1 leading to printing by printer 1 in normal course.

Figure 2:
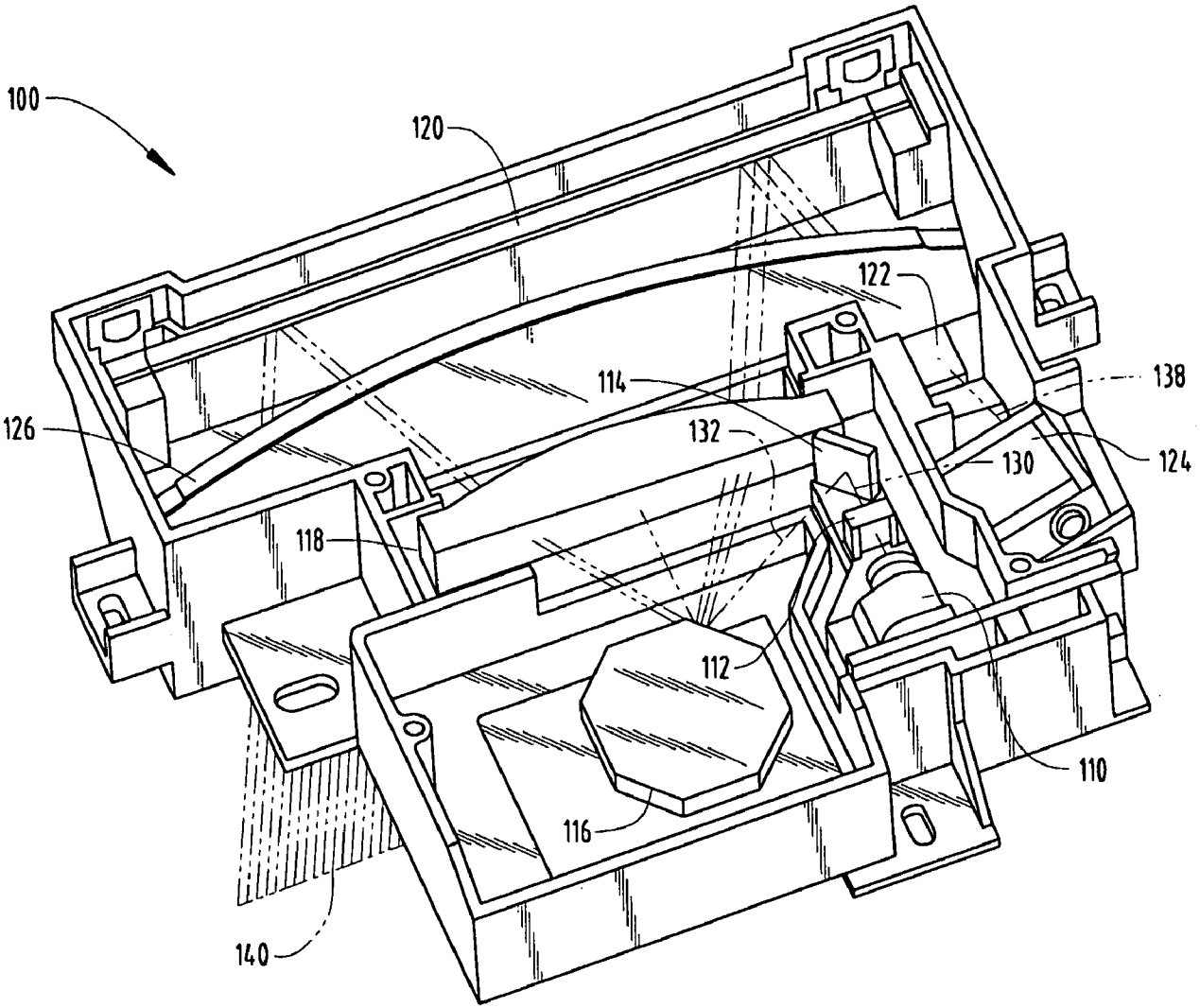
FIG. 2 is a perspective view in partial cut-away of a laser printhead particularly showing the details of the light pathways from the laser.

FIG. 2 provides a perspective partially cut-away view of some of the major components of a printhead 100 of laser printer 10. Starting at the laser light source 110, the light travels through a lens 112 along a pathway 130 and is redirected by a "pre-scan" mirror 114. The redirected light path, designated by a reference numeral 132, puts a spot of light on an eight-sided polygonal mirror 116. Some of the other major optical components within laser printer 10 include a lens 118, a "post-scan" fold mirror 120, a "start of scan" mirror 122, an optical sensor mounted to an HSYNC sensor card 124, and another lens 126 that directs the light into a "writing line" designated by the reference numeral 140.

A portion of the swept light that creates each raster scan is aimed by the polygonal mirror 116, lens 118, fold mirror 120, and a "start of scan" mirror 122 to create a light signal that follows the path designated by the reference numeral 138. Light that ultimately travels along path 138 will be directed to impact an optical sensor on the HSYNC sensor card 124 and the optical sensor is equivalent to the HSYNC sensor 52, seen on FIG. 1. In FIG. 2 since there are eight (8) facets or sides to polygonal mirror 116, each one-eighth rotation of mirror 116 will create an entire swept raster scan of laser light that ultimately becomes the writing line 140. For a small instant at the start of each of these scans, there will be a light beam that travels along path 138 to impact the HSYNC sensor 52 on the HSYNC sensor card 124. This HSYNC signal will be created during each scan at all times during normal operation of laser printer 110 when the printhead is running, even during scans in which there are no pels to be printed on the photoconductive drum. Laser source 110 is controlled such that it will produce no light at all for raster lines that are to be left blank on the final printed page, except for a brief moment at the end of each scan, so that the HSYNC signal will be produced at the beginning of each successive scan.

Figure 3:
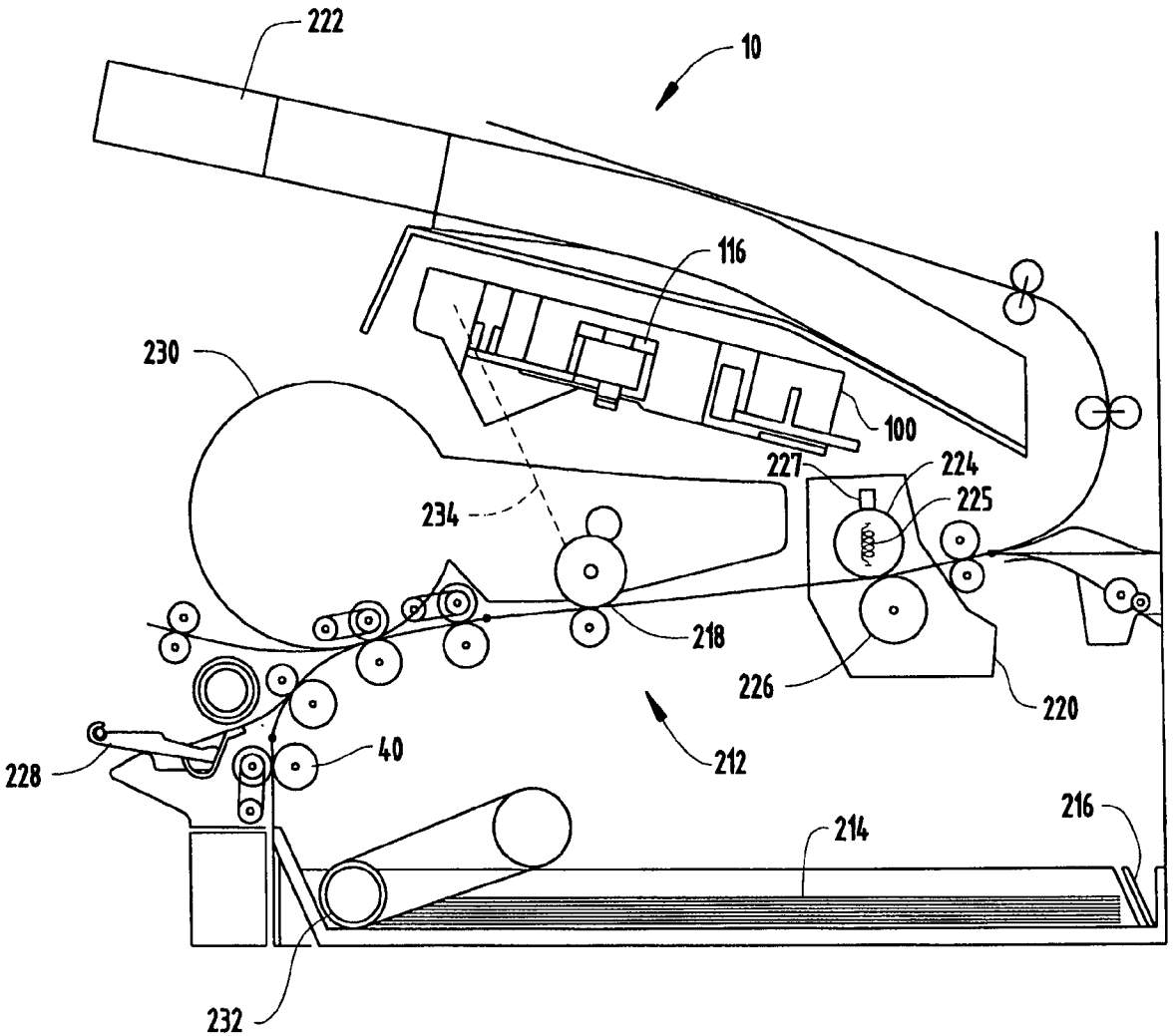
FIG. 3 is a cutaway, diagrammatic side view of an electrophotographic printer.

Major elements of the printer as a whole are illustrated in FIG. 3. Printer 10 includes a media feed path 212 for feeding sheets or media 214, such as paper, from a media tray 216 past a photoconductive drum 218 and a fuser assembly 220 to an input tray 222. Fuser 220 is nip roller fuser, as is conventional, formed by a heated roller 224, which is heated to a high enough temperature to fix particles of electrophotographic toner to the sheets media 214 by melt flow. Roller 226 is a backup roller to apply some pressure during the fixing. Heating lamp 225 is inside roller 224 and powered by current from power supply 12. As is not generally conventional, lamp 225 in operation does not draw sufficient power from power supply 12 to cause flicker or the like. Accordingly, fuser 220 is somewhat slower than are some fusers in reaching operating temperatures. Fuser temperature is sensed by a conventional sensor 227 in contact with or near heated roller 224.

Special media, such as envelopes and index cards, are fed into the media feed path 212 from an external, front tray 228, sometimes referred to as a multi-purpose tray. Special media may also be fed from a separate, external tray (not shown). The photoconductive drum 218 forms an integral part of a replaceable toner cartridge 230 inserted in to printer 10. A print head 100 is disposed in the printer 10 for scanning the photoconductive drum 218 with a laser beam 234 so that it ultimately sweeps or "scans" across a "writing line" on the photoconductive drum 218 as described in the foregoing, thereby creating, in a black and white laser printer, a raster line of either black or white print elements, also known as "pels". Pivoted roller 232 feeds sheets from tray 216. Other nip rollers shown in FIG. 1 are sheet feed rollers to feed paper or other media.

Cold Start Control

This invention is operative in the foregoing embodiment when printer 10 is turned on from a cold start, which encompasses when the printer is on but the fuser is unheated (often termed "power saver" mode). If printer 10 is maintained partially warmed, often termed "standby" mode, mirror 116 is not driven, and another essential delay may be for mirror 116 to reach "lock" as discussed in the foregoing.

The dominant delay from a cold-fuser start is for fuser 220 to reach operating temperature. Additionally, where the media is thick or heavy, such as transparencies and many labels, the fuser 220 must be warmed to more than a lower temperature suitable for paper and the like. It is conventional for the control system, implemented in the embodiment by microprocessor 14, to track the fuser temperature and to launch a media sheet so that the sheet arrives at the fuser nip at the same time or soon after the fuser 220 reaches this desired temperature. The resulting delay typically is about 30 seconds.

In accordance with this invention, when the media to be printed at cold start is identified as heavy or thick, by executing software stored in ROM 16 the control system implemented by microprocessor adds an additional delay before launching the sheet—with a total delay of 40 to 45 seconds being representative. Accordingly, the launching of the media 214 from tray 216 or media from an alternative source is delayed those predetermined amounts regardless of other factors. The additional delay may be by launching media 214 only when temperature sensed at fuser 220 is higher than that at which media 214 is normally launched. Alternatively, the delay may be imposed as a predetermined time period between start of warming and launch of media 214. Individual values or tables of values depending on the need for this purpose are stored in ROM 16 or built into ASIC 40. A table of values would be used if different delays are to be imposed on, for example, each of transparencies, card stock and labels. A table might be used for different delays at different print speeds.

In specific situations an even longer delay may be imposed, for example, when mirror 116 has not reached "lock".

OPERATOR INPUT

Figure 4:
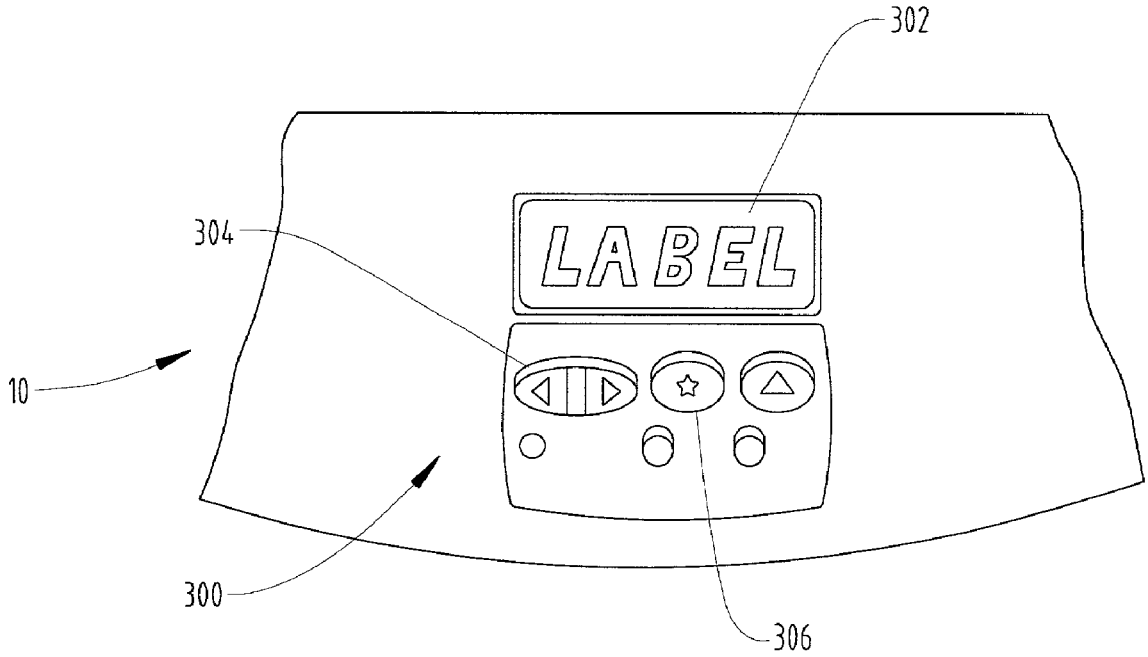
FIG. 4 illustrates a control panel for operator entry of such a printer.

FIG. 4 shows a representative control panel 300 on printer 10. It is on the outside, front of printer 10 and readily accessible to a human operator. In this particular embodiment, the control panel has a variable display 302, the information displayed being provided under the control of microprocessor 14. With such a display, it is possible to have a list of alternatives for input displayed one at a time on display 302, each being presented in a predetermined order by the pressing of a control button 304, often termed a "menu" button. To enter control information for thick or heavy paper, the operator presses menu button 304 until the corresponding term is displayed. In this illustration the term "LABEL" is used as readily recognized and remembered by the operator. When that term appears, the select button 306 is depressed by the operator, and microprocessor 14 responds to this information stored in memory 32 by delaying start as described in the foregoing. The other buttons shown are for various other operator-control entries to printer 10.

Entry of the thick-or-heavy media information may be by any available alternative. The print job received by printer 10 on its ports 18 and 20 may have information code (often termed "header" code) that identifies the media. The print job may call for feeding from a tray reserved or unique to heavy or thick media, and therefore may be known to the control system as necessarily being heavy or thick.

This invention combines a heating system not capable of causing flicker or other significant drain of power with a delay at cold start to achieve reliable operation. As it can be implemented by only changing the control code of a microprocessor, tangible costs to practice this invention are generally insignificant. Exact time periods and characteristics of the heating system are a matter of ordinary design, depending upon the details of the printer.

What is claimed is:

1. A method for producing an image on a media sheet in an imaging device comprising:

providing an imaging device having a motor and a heating element to effect final imaging, said imaging device powered from an electric power supply and having a control system to initiate and control said imaging device starting from a cold state;

supplying electric power from a power source to said image device, wherein said power source is connected to other power-drawing components, wherein said heating element draws said electric power such that flicker is avoided in said other power-drawing components connected to said power source;

at start from said cold state, initiating heating of said heating element;

identifying to said control system media to be imaged that is heavy or thick or that is not heavy or thick;

identifying to said control system whether said motor has reached a selected rotational speed;

if said media is identified as not heavy or thick and said motor has reached said selected rotational speed, launching said media that is not heavy or thick after a first delay from initiating said heating at said start from said cold state, wherein said first delay is a delay that results from launching said media so that said media arrives at said heating element when said heating element reaches a predetermined temperature suitable for said media that is not heavy or thick; and if said media is identified as heavy or thick and said motor has reached said selected rotational speed, launching said media that is heavy or thick after a second delay from initiating said heating at said start from said cold state, wherein said second delay is longer than said first delay.

2. The method of claim 1 wherein said heating element is a fuser for an electrophotographic toner.

3. The method of claim 1 wherein said imaging device is a printer.

4. The method of claim 2 wherein said imaging device is a printer.

* * * * *